United States Patent [19]

Gaede

[11] 4,359,019

[45] Nov. 16, 1982

[54] PROCESS FOR PREVENTING THE PUMPING OF A HYDRAULIC VALVE CLEARANCE COMPENSATING ELEMENT IN VALVE OPERATING MECHANISMS OF INTERNAL COMBUSTION ENGINES

[75] Inventor: Georg Gaede, Munich, Fed. Rep. of Germany

[73] Assignee: Bayerische Motoren Werke Aktiengesellschaft, Munich, Fed. Rep. of Germany

[21] Appl. No.: 100,026

[22] Filed: Dec. 3, 1979

[30] Foreign Application Priority Data

Dec. 2, 1978 [DE] Fed. Rep. of Germany ..... 2852293

[51] Int. Cl.[3] ..... F01L 1/18; F01L 1/24

[52] U.S. Cl. ..... 123/90.46; 123/90.44

[58] Field of Search ..... 123/90.12, 90.27, 90.39, 123/90.41, 90.44, 90.45, 90.46, 90.43, 90.55, 90.56, 90.57, 90.58

[56] References Cited

U.S. PATENT DOCUMENTS

| | | | |
|---|---|---|---|
| 1,792,795 | 2/1931 | Almen | 123/90.12 |
| 2,615,438 | 10/1952 | Tucker | 123/90.12 |
| 3,124,115 | 3/1964 | Voorhies | 123/90.55 |
| 4,167,931 | 9/1979 | Iizuka | 123/90.46 |
| 4,241,707 | 12/1980 | Mayr et al. | 123/90.55 |

FOREIGN PATENT DOCUMENTS

| | | | |
|---|---|---|---|
| 939057 | 2/1956 | Fed. Rep. of Germany | 123/90.44 |

*Primary Examiner*—Craig R. Feinberg
*Assistant Examiner*—W. R. Wolfe
*Attorney, Agent, or Firm*—Paul M. Craig, Jr.

[57] ABSTRACT

Process for preventing the pumping of a hydraulic valve clearance compensating element in a valve operating mechanism of an internal combustion engine, wherein a valve actuating lever is supported by means of a hydraulic valve clearance compensating element in a bearing zone of the lever and is controlled by a cam is disclosed. The process is characterized in that during operation of the engine, an auxiliary force which counteracts a compensating force of the valve clearance compensating element, and which is greater than the compensating force, is applied to the valve clearance compensating element only during a valve lifting phase of the cam in response to movement of the cam, the auxiliary force acting upon the bearing zone of the lever and being independent of a bearing force of the valve actuating lever.

1 Claim, 2 Drawing Figures

PROCESS FOR PREVENTING THE PUMPING OF A HYDRAULIC VALVE CLEARANCE COMPENSATING ELEMENT IN VALVE OPERATING MECHANISMS OF INTERNAL COMBUSTION ENGINES

BACKGROUND AND SUMMARY OF THE INVENTION

The present invention relates to a process for preventing the pumping of a hydraulic valve clearance compensating element in a valve operating mechanism of an internal combustion engine, wherein a valve actuating lever is supported by means of a hydraulic valve clearance compensating element and is controlled by a cam and to a valve operating mechanism for conducting this process.

In valve operating mechanisms of internal combustion engines, the positive connection between the valve actuating lever and the cam shaft is frequently lost, especially at high speeds, so that the so-called "valve soaring" occurs. When using hydraulic valve clearance compensating elements, this leads to the so-called "pumping" thereof, due to their resetting function, so that the valves can no longer close entirely.

An object of the present invention is to provide a process for preventing the pumping of the hydraulic valve clearance elements in internal combustion engines with a valve operating mechanism of the aforementioned type of construction, as well as a valve operating mechanism for conducting this process.

This object has been attained according to the present invention in that in the process of the present invention during the valve lifting phase of the cam an auxiliary force is applied to the valve clearance compensating element, counteracting the compensating force of this valve clearance element, this force being greater than the compensating force and being independent of the bearing force of the valve actuating lever. The valve operating mechanism of the present invention for conducting this process includes a structural arrangement which is responsive to the movement of the cam for applying an auxiliary force to the valve clearance compensating element, the auxiliary force during the valve lifting phase of the cam being greater than and directed to counteract the compensating force of the valve clearance compensating element.

According to a disclosed embodiment of the present invention the valve operating mechanism includes a rod which is supported at one end and which resiliently contacts the valve actuating lever at its other end, the rod contacting the valve actuating lever in a bearing zone of the lever and on a side of the lever in opposition to the valve clearance compensating element. A section of the rod is positioned with respect to the cam so as to respond to the movement of the cam during the valve lifting phase thereof whereby the auxiliary force is applied to the compensating element.

In this disclosed embodiment the rod is resilient and is mounted so as to be pretensioned when resiliently contacting the lever, the tension in the rod being increased in response to the movement of the cam during the valve lifting phase thereof. The movement of the cam during this valve lifting phase is transmitted to the rod via the valve actuating lever in that the valve actuating lever contacts the cam with a sliding surface on the lever and the rod in turn contacts an abutment surface formed on the lever in close proximity of the sliding surface and in opposition thereto.

According to the disclosed embodiment of the valve operating mechanism the rod has a bifurcate section at one end and contacts, with the legs of the bifurcate section, the abutment surface which is arranged on both sides of the lever.

It is possible by means of the process of this invention in conjunction with the valve operating mechanism of the invention to effectively prevent th pumping of the valve clearance compensating element and maintain the function of this element during the base circle phase of the cam, so that valve clearance compensation is ensured.

These and other objects, features and advantages of the present invention will become more apparent from the following description when taken in connection with the accompanying drawing which shows, for purposes of illustration only, one embodiment in accordance with the present invention.

DETAILED DESCRIPTION OF THE DRAWING

Figure 1:
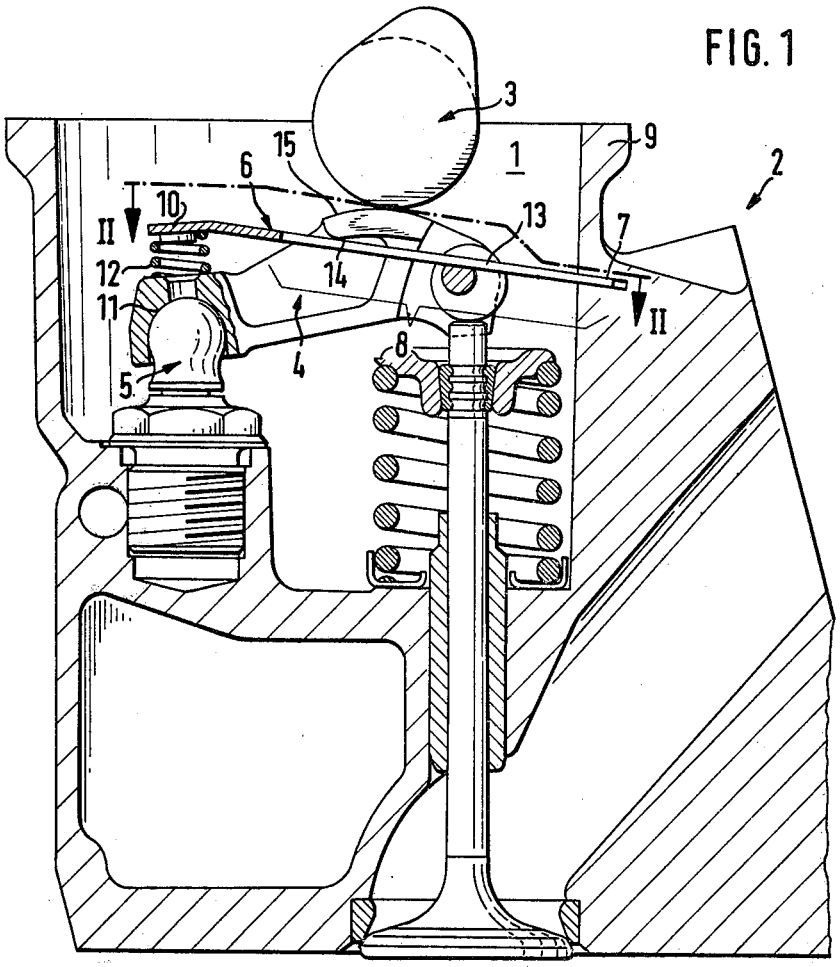
FIG. 1 is a section through a cylinder head of an internal combustion engine, which latter is not illustrated in detail, comprising a valve operating mechanism of the present invention arranged therein in a so-called valve chamber.
Figure 2:
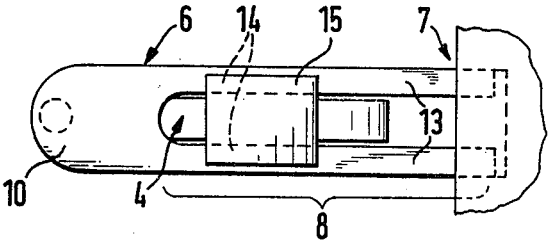
FIG. 2 is a top view of the cylinder head of FIG. 1, taken as a section along line II—II of FIG. 1.

Referring to the application drawing, according to the present invention, a valve operating mechanism is arranged in the valve chamber 1 of a cylinder head 2 of an internal combustion engine, which latter is not illustrated in detail. The valve drive mechanism comprises a camshaft 3, a drag lever 4, and a valve clearance compensating element 5. The drag lever 4 is supported on the valve clearance compensating element 5 in the manner of a ball-and-socket joint. A bifurcate, resilient rod 6 is clamped with the open end 7 of its forked section 8 into a wall 9 of the valve chamber 1 and terminates with its free end 10 in the zone of the bearing 11 of the drag lever 4; and on the side in opposition to the valve clearance compensating element 5, the rod contacts the drag lever 4 by way of a compression spring 12. The resilient rod 6 furthermore contacts, with the legs 13 of its bifurcate section 8, on both sides abutment surfaces 14 of the drag lever 4, these abutment surfaces being formed in the proximity of the sliding surface 15 at the lever 4 and in opposition to this sliding surface of the lever.

The spring forces of the rod 6, which is clamped in position in an essentially linear fashion, and of the compression spring 12 are chosen so that they are smaller than the compensating force in the valve clearance compensating element 5 composed of oil pressure and spring force, as long as the sliding surface 15 of the drag lever 4 is in contact with the portion of the cam working path formed by the base circle of the cam. If the cam presses, with its portion of the cam working path located in the zone of the raised portion of the cam, onto the sliding surface 15 of the drag lever 4, the rod 6 is urged downwardly together with the drag lever 4, thus reinforcing the force occurring at the free end 10 of the rod 6 so that it exceeds the compensating force. That is, an auxiliary force which is greater than the compensating force is applied to the compensating element only during the valve lifting phase of the cam in response to movement of said cam. Thereby, on the one hand, the continuous compensation of the valve clearance is not impeded and, on the other hand, a pumping of the valve clearance compensating element 5, caused by a lack of positive connection between the cam and the drag lever, is avoided.

The spacing of the legs 13 of the bifurcate section 8 is advantageously adapted to the width of the drag lever 4 so that thereby a lateral guidance of the drag lever 4 is achieved. As a result, the machining of the end of the drag lever 4 contacting the valve stem can be simplified, since no lateral guide surfaces need to be worked.

With appropriate modification, this principle can also be applied to rocking levers such as rocker arms.

While I have shown and described one embodiment in accordance with the present invention, it is understood that the same is not limited thereto but is susceptible of numerous changes and modification as known to those skilled in the art, and I therefore do not wish to be limited to the details shown and described herein but intend to cover all such changes and modifications as are encompassed by the scope of the appended claims.

I claim:

1. Process for preventing the pumping of a hydraulic valve clearance compensating element in a valve operating mechanism of an internal combustion engine, wherein a valve actuating lever is supported by means of a hydraulic valve clearance compensating element in a bearing zone of said lever and is controlled by a cam, characterized in that during operation of said engine, an auxiliary force which counteracts a compensating force of the valve clearance compensating element, and which is greater than said compensating force, is applied to the valve clearance compensating element only during a valve lifting phase of the cam in response to movement of said cam, said auxiliary force acting upon the bearing zone of said lever and being independent of a bearing force of the valve actuating lever.

* * * * *